US009757967B2

(12) United States Patent
Muraji

(10) Patent No.: US 9,757,967 B2
(45) Date of Patent: Sep. 12, 2017

(54) TESTING CHART, A CORRECTION VALUE ACQUIRING METHOD FOR AN INKJET PRINTING APPARATUS, AND AN INKJET PRINTING APPARATUS

(71) Applicant: SCREEN HOLDINGS CO., LTD., Kyoto (JP)

(72) Inventor: Kunio Muraji, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 0 days.

(21) Appl. No.: 15/270,291

(22) Filed: Sep. 20, 2016

(65) Prior Publication Data

US 2017/0087907 A1 Mar. 30, 2017

(30) Foreign Application Priority Data

Sep. 29, 2015 (JP) ..... 2015-191543

(51) Int. Cl.
*B41J 29/38* (2006.01)
*B41J 2/01* (2006.01)

(52) U.S. Cl.
CPC *B41J 29/38* (2013.01); *B41J 2/01* (2013.01)

(58) Field of Classification Search
CPC ..... B41J 2/04505; B41J 2/04503; B41J 2/04508; B41J 2/04515; B41J 2/04513; B41J 2/2135; B41J 2/2139; B41J 2/2146; B41J 2/2142; B41J 2/2132; B41J 2/512; B41J 11/42; B41J 11/425; B41J 19/145
See application file for complete search history.

(56) References Cited

U.S. PATENT DOCUMENTS

2006/0187251 A1* 8/2006 Pulver ..... B41J 2/04505 347/19
2008/0018692 A1* 1/2008 Endo ..... B41J 2/0451 347/19
2008/0094439 A1* 4/2008 Yoshida ..... B41J 29/393 347/19

FOREIGN PATENT DOCUMENTS

JP H05-116342 A 5/1993
JP 2011-148287 A 8/2011

* cited by examiner

*Primary Examiner* — Kristal Feggins
(74) *Attorney, Agent, or Firm* — McDermott Will & Emery LLP

(57) ABSTRACT

A drive circuit for driving a plurality of nozzles to discharge ink droplets. The testing chart comprises a contrast chart including a first line segment group having first line segments formed by causing the drive circuit to output a reference drive signal for a density serving as reference, thereby to make discharge from a first number of driven nozzles, the first line segments extending in a direction perpendicular to a transport direction and arranged at predetermined intervals, and a second line segment group having second line segments formed by causing the drive circuit to output a drive signal for driving only a selected number of nozzles as target of correction less than the first number of driven nozzles, the second line segments being formed between the first line segments while changing the correction values for correcting the drive signal of the drive circuit.

20 Claims, 8 Drawing Sheets

TESTING CHART, A CORRECTION VALUE ACQUIRING METHOD FOR AN INKJET PRINTING APPARATUS, AND AN INKJET PRINTING APPARATUS

CROSS-REFERENCE TO RELATED APPLICATIONS

This application claims priority to Japanese Patent Application No. 2015-191543 filed Sep. 29, 2015 the subject matter of which is incorporated herein by reference in entirety.

BACKGROUND OF THE INVENTION (1) Field of the Invention

This invention relates to a testing chart for acquiring a correction value for use in discharge correction in an inkjet printing apparatus which discharges ink droplets to form images on a printing medium, to a correction value acquiring method for an inkjet printing apparatus, and to an inkjet printing apparatus.

(2) Description of the Related Art

An inkjet printing apparatus discharges ink droplets from an inkjet head having a plurality of nozzles to printing paper to form images thereon. At this time, the number of nozzles which simultaneously discharge ink droplets increases or decreases according to an image to be formed, and this causes variations in the pressure loss in the inkjet head and in the load of a drive circuit. As a result, ink droplet discharge characteristics of the inkjet head vary from time to time, causing a reduction in printing quality.

Under the circumstances, the following apparatus have been proposed as techniques for solves such problem.

A first apparatus has a detector for detecting the number of nozzles which discharge ink droplets among a plurality of nozzles constituting an inkjet head. In response to the number of nozzles detected by this detector, a drive signal for discharging ink droplets from the inkjet head is adjusted with a correction value (see Japanese Unexamined Patent Publication H5-116342, for example).

A second apparatus has correction tables storing beforehand amounts of correction of a drive signal matched with numbers of nozzles which discharge ink droplets, and an image data counter for counting the number of nozzles which discharge ink droplets at the same time. The apparatus reads a correction table corresponding to the number of nozzles counted by this image data counter, and adjusts the discharge timing of ink droplets with the amount of correction matched therewith (see Japanese Unexamined Patent Publication No. 2011-148287, for example).

However, the conventional examples with such constructions have the following problems.

That is, the conventional apparatus, which require correction values corresponding to numbers of nozzles discharging at the same time, have a problem that the correction values cannot be obtained easily.

Incidentally, in order to obtain the correction values, it is conceivable to use a characteristic measuring device for the inkjet head (see Japanese Unexamined Patent Publication No. 2011-101870, for example). However, since it is necessary to take the trouble of using such characteristic measuring device, it is after all not easy to acquire the correction values, and besides there is a problem of taking a long time until a correction value is obtained. Moreover, since the conditions at the time of measurement differ from actual printing conditions (e.g. types of printing paper), even the correction value acquired in this way will not necessarily bring satisfactory correction results. Further, in order to meet the latest requirement for high resolution, the inkjet head may be constructed by combining a plurality of head modules, for example. Since only a correction value for each individual head module is obtained from the characteristic measuring device, there is a problem of being unable to carry out correction accurately for one inkjet head whose operation relies on the combination of these head modules.

SUMMARY OF THE INVENTION

This invention has been made having regard to the state of the art noted above, and its object is to provide a testing chart, a correction value acquiring method for an inkjet printing apparatus, and an inkjet printing apparatus, which can acquire correction values corresponding to the number of nozzles easily in a short time.

To fulfill the above object, this invention provides the following construction.

In an inkjet printing apparatus for forming images on a printing medium with an inkjet head by operating a drive circuit for driving a plurality of nozzles which discharge ink droplets, a testing chart for obtaining correction values for the drive circuit, the testing chart comprising a contrast chart including a first line segment group having first line segments formed on the printing medium by causing the drive circuit to output a reference drive signal for a density serving as reference, thereby to make discharge from a first number of driven nozzles of the plurality of nozzles, the first line segments extending in a direction perpendicular to a transport direction of the printing medium and arranged at predetermined intervals in the transport direction; and a second line segment group having second line segments formed on the printing medium by causing the drive circuit to output a drive signal for driving only a selected number of nozzles as target of correction less than the first number of driven nozzles, the second line segments being formed between the first line segments of the first line segment group while changing the correction values for correcting the drive signal of the drive circuit.

According to this invention, a contrast chart is provided which includes a first line segment group having first line segments formed by causing the drive circuit to output a reference drive signal, thereby to make discharge from a first number of driven nozzles, the first line segments extending in a direction perpendicular to a transport direction of the printing medium and arranged at predetermined intervals in the transport direction, and a second line segment group having second line segments formed by driving only a selected number of nozzles less than the first line segments, the second line segments being formed between the first line segments while changing the correction values for correcting the drive signal. Therefore, when the density of each first line segment and that of each second line segment on the contrast chart are compared in the transport direction of the printing medium, and a second line segment having a density substantially in agreement with that of the first line segment is identified, the correction value corresponding to that second line segment shows a difference from the reference drive signal. By depicting this testing chart, therefore, correction values corresponding to the number of nozzles at the time of image formation can be acquired easily in a short time.

In this invention, it is preferred that the contrast chart is provided in a plurality of types by changing the selected number.

By forming the contrast chart in a plurality of types, correction values can be obtained with increased accuracy according to different selected numbers of nozzles.

In this invention, it is preferred that the inkjet head comprises a plurality of head modules each having a plurality of nozzles, and each head module having the drive circuit for driving each of the nozzles of the head module, and wherein the contrast chart includes the first line segment group formed by the plurality of nozzles of a reference head module which is a given one of the head modules; the second line segment group formed by the selected number of nozzles of the reference head module; and a reverse contrast chart including a third line segment group having third line segments formed on the printing medium by causing the drive circuit to output the reference drive signal for the density serving as reference, thereby to make discharge only from the selected number of nozzles of the plurality of nozzles of an other head module adjacent the reference head module, the third line segments being arranged adjacent spaces between the first line segments of the first line segment group in the contrast chart; and a fourth line segment group having fourth line segments formed on the printing medium by causing the drive circuit to output a drive signal for driving the plurality of nozzles of the other head module, the fourth line segments being formed between the third line segments of the third line segment group while changing the correction values for correcting the drive signal of the drive circuit.

When the density of each first line segment and that of each second line segment on the contrast chart are compared in the transport direction of the printing medium, and a second line segment having a density substantially in agreement with that of the first line segment is identified, the correction value corresponding to that second line segment shows a difference from the reference drive signal within the reference head module. When the density of each third line segment and that of each fourth line segment on the reverse contrast chart are compared in the transport direction of the printing medium, and a fourth line segment having a density substantially in agreement with that of the third line segment is identified, the correction value corresponding to that fourth line segment shows a difference from the reference drive signal of the other head module. Further, when the density of each first line segment and that of each fourth line segment on the contrast chart and the reverse contrast chart are compared in the direction perpendicular to the transport direction of the printing medium, and a fourth line segment having a density substantially in agreement with that of the first line segment is identified, the correction value corresponding to that fourth line segment shows a difference of the other module from the reference drive signal of the reference head module. By depicting these contrast chart and reverse contrast chart, therefore, correction values corresponding to the number of nozzles in the reference head module and other head module at the time of image formation can be acquired easily in a short time. Moreover, since a correction value can be obtained for correcting a density difference by the reference driving signal between the reference head module and other head module, a correction value for uniforming density between these head modules can be acquired easily in a short time.

In another aspect of this invention, the following method is provided.

In an inkjet printing apparatus for forming images on a printing medium with an inkjet head by operating a drive circuit for driving a plurality of nozzles which discharge ink droplets, a correction value acquiring method for obtaining correction values for the drive circuit, the method comprising a selecting step for selecting a number of nozzles as target of correction less that the plurality of nozzles; a testing chart forming step for forming a testing chart with a contrast chart including a first line segment group having first line segments formed on the printing medium by causing the drive circuit to output a reference drive signal for a density serving as reference, thereby to make discharge from a first number of driven nozzles of the plurality of nozzles, the first line segments extending in a direction perpendicular to a transport direction of the printing medium and arranged at predetermined intervals in the transport direction, and a second line segment group having second line segments formed on the printing medium by causing the drive circuit to output a drive signal for driving only a selected number of nozzles as target of correction less than the first number of driven nozzles, the second line segments being formed between the first line segments of the first line segment group while changing the correction values for correcting the drive signal of the drive circuit; an identifying step for identifying a second line segment whose density substantially corresponds to that of the first line segments by comparing, in the transport direction of the printing medium, the density of each of the first line segments and the density of each of the second line segments from the testing chart; and a correction value acquiring step for acquiring a correction value corresponding to the second line segment identified.

According to this invention, the testing chart forming step forms a contrast chart which includes a first line segment group having first line segments formed by causing the drive circuit to output a reference drive signal, thereby to make discharge from a first number of driven nozzles, the first line segments extending in a direction perpendicular to a transport direction of the printing medium and arranged at predetermined intervals in the transport direction, and a second line segment group having second line segments formed by driving only a selected number of nozzles selected in the selecting step, the second line segments being formed between the first line segments while changing the correction values for correcting the drive signal. Then, based on the testing chart, the identifying step compares the density of each first line segment and that of each second line segment on the contrast chart in the transport direction of the printing medium, and identifies a second line segment having a density substantially in agreement with that of the first line segment. The correction value acquiring step acquires a correction value corresponding to that second line segment and showing a difference from the reference drive signal. By depicting this testing chart, therefore, correction values corresponding to the number of nozzles at the time of image formation can be acquired easily in a short time.

In this invention, it is preferred that the testing chart forming step is executed to form a plurality of contrast charts while changing the selected number in the selecting step.

By forming a plurality of contrast charts, correction values can be obtained with increased accuracy according to different selected numbers of nozzles.

In this invention, it is preferred that the inkjet head comprises a plurality of head modules each having a plurality of nozzles, and each head module having the drive circuit for driving each of the nozzles of the head modules, wherein the contrast chart includes the first line segment group formed by the plurality of nozzles of a reference head module which is a given one of the head modules; the second line segment group formed by the selected number of nozzles of the reference head module; and a reverse contrast chart including a third line segment group having third line segments formed on the printing medium by causing the drive circuit to output the reference drive signal for the density serving as reference, thereby to making discharge only from the selected number of nozzles of the plurality of nozzles of an other head module adjacent the reference head module, the third line segments being arranged adjacent spaces between the first line segments of the first line segment group in the contrast chart; and a fourth line segment group having fourth line segments formed on the printing medium by causing the drive circuit to output a drive signal for driving the plurality of nozzles of the other head module, the fourth line segments being formed between the third line segments of the third line segment group while changing the correction values for correcting the drive signal of the drive circuit; wherein the identifying step is executed to identify the second line segment whose density substantially corresponds to that of the first line segments by comparing, in the transport direction of the printing medium, the density of each of the first line segments and the density of each of the second line segments in the testing chart, to identify the fourth line segment whose density substantially corresponds to that of the third line segment by comparing, in the transport direction of the printing medium, the density of each of the third line segments and the density of each of the fourth line segments, and to identify the fourth line segment whose density substantially corresponds to that of the first line segment by comparing, in the direction perpendicular to the transport direction of the printing medium, the density of each of the first line segments and the density of each of the fourth line segments; and wherein the correction value acquiring step is executed to acquire a correction value corresponding to the second line segment identified as an intra-head correction value for the reference head module, to acquire a correction value corresponding to the fourth line segment identified as an intra-head correction value for the other head module, and to acquire a correction value corresponding to the fourth line segment identified in the direction perpendicular to the transport direction of the printing medium as an inter-head correction value for the other head module and the reference head module.

The identifying step identifies a second line segment having a density substantially in agreement with that of the first line segment by comparing, in the transport direction of the printing medium, the density of each first line segment and that of each second line segment on the contrast chart of the testing chart formed in the testing chart forming step. The correction value acquiring step acquires a correction value corresponding to that second line segment and showing a difference from the reference drive signal within the reference head module. The identifying step also identifies a fourth line segment having a density substantially in agreement with that of the third line segment by comparing, in the transport direction of the printing medium, the density of each third line segment and that of each fourth line segment on the contrast chart of the testing chart formed in the testing chart forming step. The correction value acquiring step acquires a correction value corresponding to that fourth line segment and showing a difference from the reference drive signal of the other head module. Further, the identifying step identifies a fourth line segment having a density substantially in agreement with that of the first line segment by comparing, in the direction perpendicular to the transport direction of the printing medium, the density of each first line segment and that of each fourth line segment on the contrast chart and the reverse contrast chart. The correction value acquiring step acquires a correction value corresponding to that fourth line segment and showing a difference of the other module from the reference drive signal of the reference head module. By depicting these contrast chart and reverse contrast chart, therefore, correction values corresponding to the number of nozzles in the reference head module and other head module at the time of image formation can be acquired easily in a short time. Moreover, since a correction value can be obtained for correcting a density difference by the reference driving signal between the reference head module and other head module, a correction value for uniforming density between these head modules can be acquired easily in a short time.

In a further aspect of this invention, there is provided an inkjet printing apparatus for forming images on a printing medium with an inkjet head by operating a drive circuit for driving a plurality of nozzles which discharge ink droplets, the apparatus comprising a testing chart forming device for forming a testing chart with a contrast chart including a first line segment group having first line segments formed at predetermined intervals on the printing medium by causing, based on the testing chart, the drive circuit to output a reference drive signal for a density serving as reference, thereby to make discharge from a first number of driven nozzles of the plurality of nozzles, and a second line segment group having second line segments formed on the printing medium by causing the drive circuit to output a drive signal for driving only a selected number of nozzles as target of correction less than the first number of driven nozzles, the second line segments being formed between the first line segments of the first line segment group while changing correction values for correcting the drive signal of the drive circuit; an identifying device for identifying a second line segment whose density substantially corresponds to that of the first line segments by comparing, in the transport direction of the printing medium, the density of each of the first line segments and the density of each of the second line segments in the testing chart; a correction value acquiring device for acquiring a correction value corresponding to the second line segment identified; a correction value storage device for storing the correction value as matched with the selected number; a buffer for accumulating print data for forming prints on the printing medium; a nozzle counter for counting the number of nozzles simultaneously making discharge from the inkjet head based on the print data; and a controller for reading the correction values from the correction value storage device based on the number of nozzles and the selected number, and setting the correction values to the drive circuit to perform printing.

According to this invention, the testing chart forming device forms a contrast chart which includes a first line segment group having first line segments formed by causing the drive circuit to output a reference drive signal based on testing chart data, thereby to make discharge from a first number of driven nozzles, the first line segments extending in a direction perpendicular to a transport direction of the printing medium and arranged at predetermined intervals in the transport direction, and a second line segment group having second line segments formed by driving only a selected number of nozzles, the second line segments being formed between the first line segments while changing the correction values for correcting the drive signal. Then, based on the testing chart, the identifying device compares the density of each first line segment and that of each second line segment on the contrast chart in the transport direction of the printing medium, and identifies a second line segment having a density substantially in agreement with that of the first line segment. The correction value acquiring device acquires a correction value corresponding to that second line segment and showing a difference from the reference drive signal, and stores the correction value as matched with the selected number in the correction value storage device. By depicting this testing chart, therefore, correction values corresponding to the number of nozzles at the time of image formation can be acquired easily in a short time. When making prints, the nozzle counter counts the number of nozzles based on the print data accumulated in the buffer. Based on this number of the nozzles and the selected number, the controller sets a correction value stored in the correction value storage unit to the drive circuit. Therefore, since a correction corresponding to the number of nozzles is made in the drive circuit, a reduction in print quality due to the number of nozzles can be inhibited.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENTS

Embodiment 1

Embodiment 1 of this invention will be described hereinafter with reference to the drawings.

Figure 1:
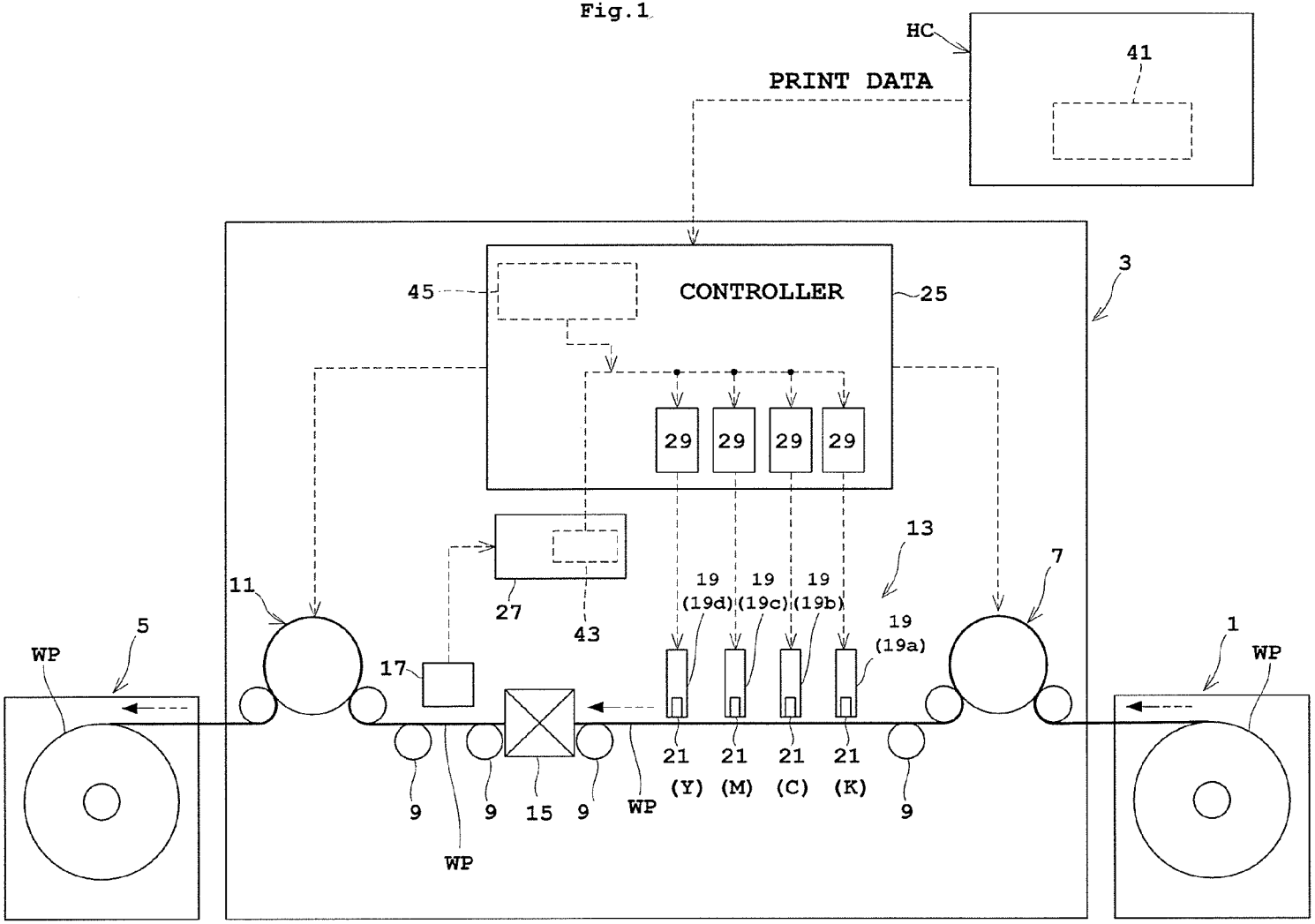
FIG. 1 is an outline schematic view showing an entire inkjet printing system according to Embodiment 1.
Figure 2:
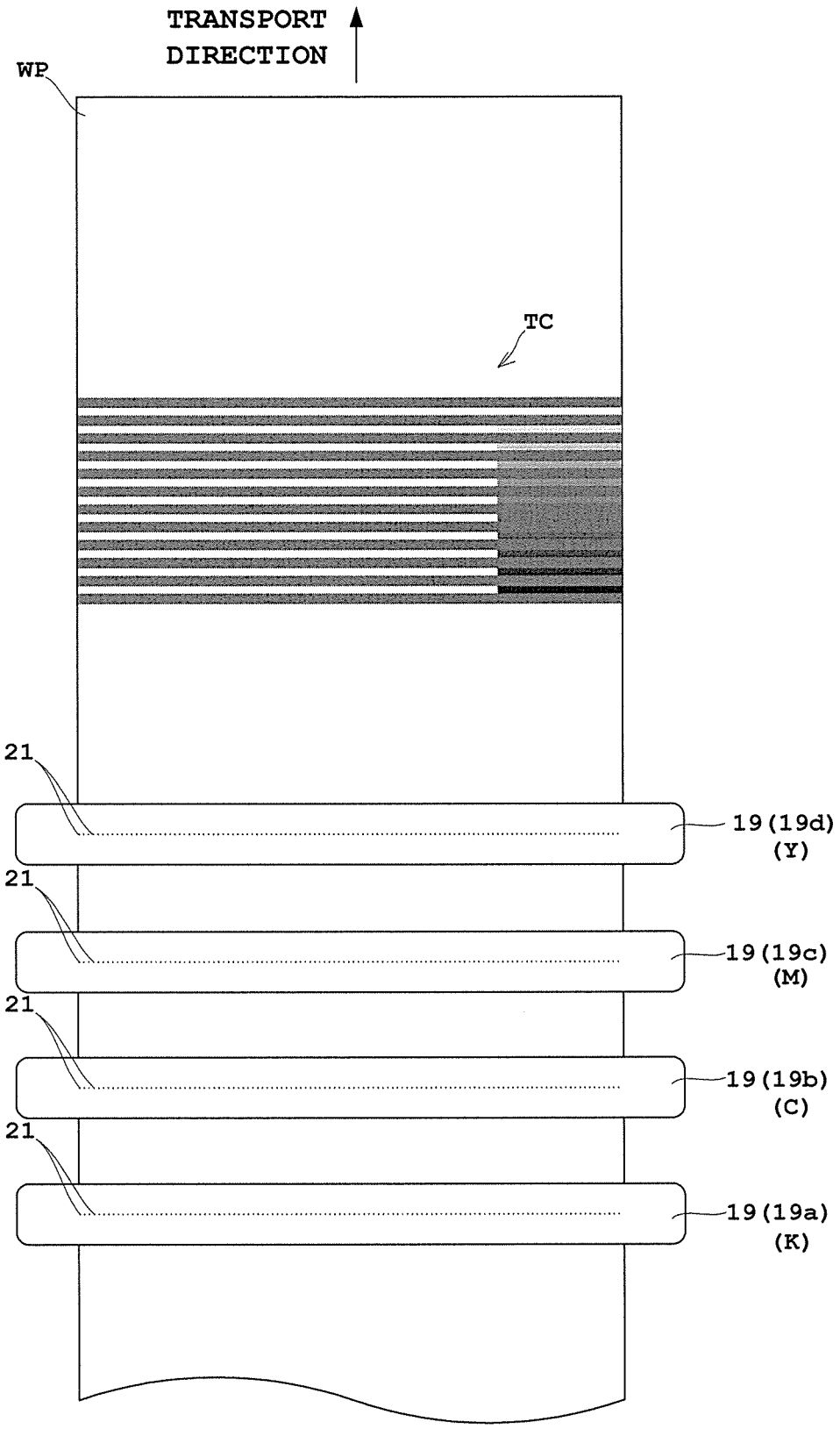
FIG. 2 is a schematic view showing a positional relationship in plan view of each print head and web paper.

FIG. 1 is an outline schematic view showing an entire inkjet printing system according to Embodiment 1. FIG. 2 is a schematic view showing a positional relationship in plan view of each print head and web paper.

The ink jet printing system according to this embodiment includes a paper feeder 1, an inkjet printing apparatus 3 and a paper discharger 5.

The paper feeder 1 holds web paper WP in a roll form to be rotatable about a horizontal axis, and unwinds and feeds the web paper WP to the inkjet printing apparatus 3. The paper discharger 5 takes up on a horizontal axis the web paper WP printed in the inkjet printing apparatus 3. Referring to the side of feeding the web paper WP as upstream and that of discharging the web paper WP as downstream, the paper feeder 1 is located upstream of the inkjet printing apparatus 3, and the paper discharger 5 downstream thereof.

The inkjet printing apparatus 3 includes a drive roller 7 disposed in an upstream position for taking in the web paper WP from the paper feeder 1. The web paper WP unwound from the paper feeder 1 by the drive roller 7 is transported downstream along a plurality of transport rollers 9 toward the paper discharger 5. A drive roller 11 is disposed between the most downstream transport roller 9 and the paper discharger 5. This drive roller 11 feeds the web paper WP transported on the transport rollers 9 forward toward the paper discharger 5.

The above web paper WP corresponds to the "printing medium" in this invention.

The inkjet printing apparatus 3 has a printing unit 13, a dryer 15 and a scanner 17 arranged in the stated order from upstream between the driving roller 7 and driving roller 11. The dryer 15 dries portions printed by the printing unit 13. The scanner 17 checks whether the printed portions have stains, omissions or other defects, and scans testing charts, which will be described hereinafter, to acquire testing image data.

The printing unit 13 has a plurality of print heads 19 for discharging ink droplets. This embodiment will be described taking a construction having four print heads 19 for example. Here, the print heads 19 will be labeled print head 19*a*, print head 19*b*, print head 19*c* and print head 19*d* in order from upstream. In this specification, when the print heads 19 need to be distinguished, an additional sign (such as "a") will be written after sign 19, but when it is not necessary to distinguish them, only sign 19 will be used. Each print head 19 has a plurality of nozzles 21 for discharging ink droplets. The plurality of nozzles 21 are arranged to form a line in a direction perpendicular to the transport direction of the web paper WP, and these nozzles 21 constitute an integral unit. These print heads 19*a*-19*d* discharge ink droplets of at least two colors, and is arranged capable of making multicolor printing on the web paper WP. Here, the print head 19*a* discharges black (K) ink, for example, the print head 19*b* discharges cyan (C) ink, print head 19*c* discharges magenta (M) ink, and print head 19*d* discharges yellow (Y) ink. The print heads 19*a*-19*d* are arranged at predetermined intervals in the transport direction.

The above print heads 19 correspond to the "inkjet head" in this invention.

The inkjet printing apparatus 3 includes a controller 25 and an image processor 27.

The controller 25 and image processor 27 are constructed of a CPU, memory and so on not shown. The controller 25 includes head controllers 29 for the respective print heads 19*a*-19*d*. In the following description, the print head 19*a* will be described by way of example, with its reference sign just 19, not 19*a*.

Figure 3:
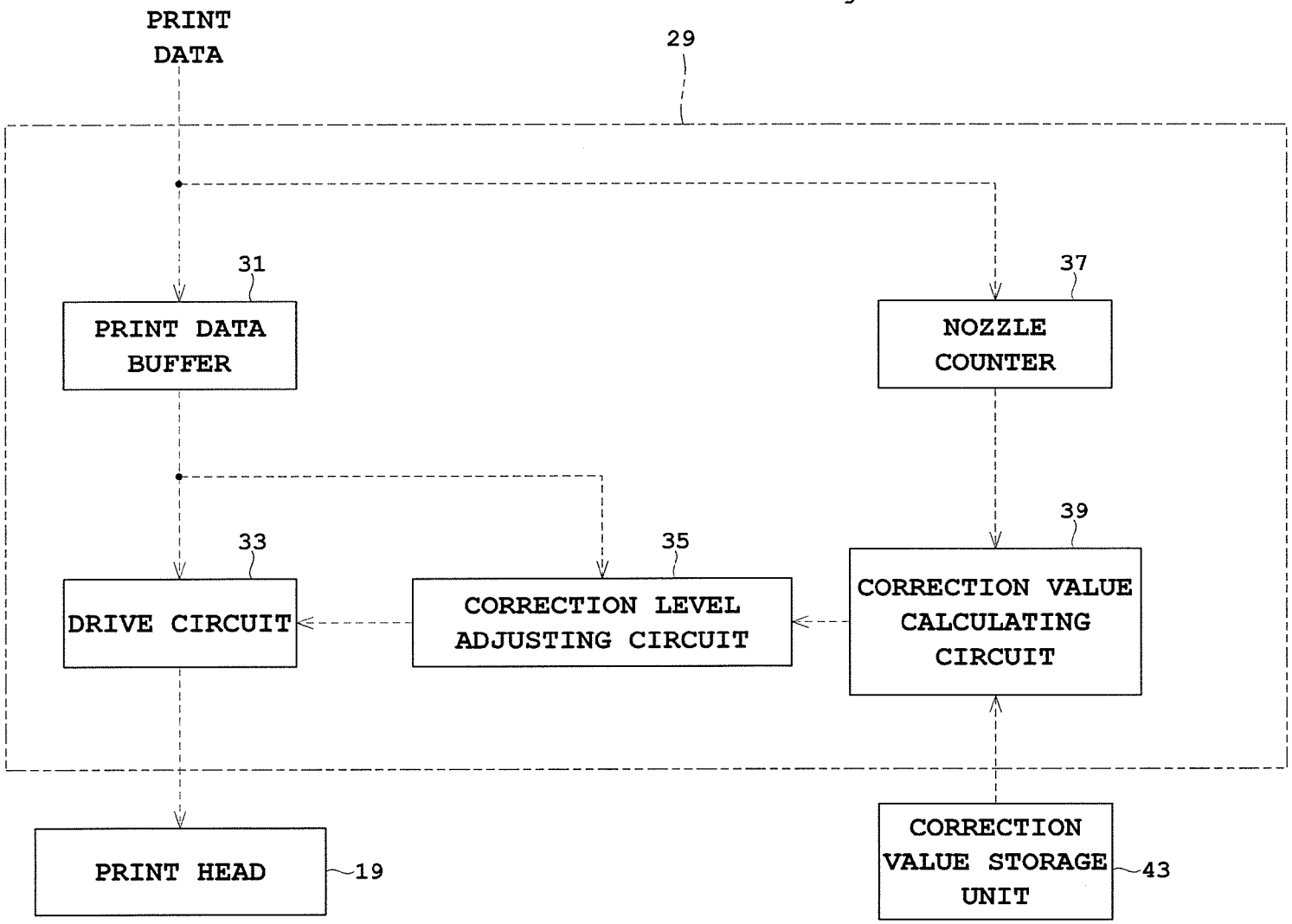
FIG. 3 is a block diagram of a head controller.

Reference will now be made to FIG. 3. FIG. 3 is a block diagram of a head controller.

Each head controller 29 includes a print data buffer 31, a drive circuit 33, a correction level adjusting circuit 35, a nozzle counter 37 and a correction value calculating circuit 39.

The print data buffer 31 receives print data from a host computer HC, and temporarily stores only a fixed quantity of data. What is stored temporarily is, of the print data, data for at least one line to be printed by the print head 19 (which corresponds to the data of an image to be formed in the direction perpendicular to the transport direction). The print data includes print data for making prints such as products, and testing chart data for printing a testing chart TC described hereinafter. The host computer HC includes a testing chart storage unit 41 for storing print data of the testing chart TC described hereinafter.

The above print data buffer 31 corresponds to the "buffer" in this invention.

The drive circuit 33 receives the print data for one line from the print data buffer 31, and gives a drive signal (e.g. drive voltage) corresponding to the print data for one line to the print head 19. However, the drive circuit 33 has correction values set by the correction level adjusting circuit 35, and operates the print head 19 after adjusting the drive signal according to the correction values. The correction level adjusting circuit 35 adjusts levels of correction values given from the correction value calculating circuit 39 according to the drive signal. The correcting level adjusting circuit 35, when printing the testing chart TC, receives correction level adjusting data (correction values) included only in the testing chart TC from the print data buffer 31, and adjusts the levels of correction values and sets them to the drive circuit 33.

The nozzle counter 37 counts the number of nozzles for one line based on the print data. That is, it counts the number of nozzles 21 on the print head 19 which discharge ink droplets all at once. The correction value calculating circuit 39, based on the number of nozzles counted and a correction value table in a correction value storage unit 43 included in the image processor 27, calculates correction values appropriate to the number of nozzles counted. From the correction value table stored in the correction value storage unit 43, which table has selected numbers and correction values matched with each other, this correction value calculating circuit 39 derives the correction values by performing an interpolating operation based on the number of nozzles counted and the correction value table. However, the correction values may simply be selected without performing calculation, as described hereinafter.

When forming the testing chart TC, the nozzle counter 37, correction value calculating circuit 39 and correction value storage unit 43 are not used. That is, when the testing chart TC is formed, the correcting level adjusting circuit 35 sets correction values to the drive circuit 33 in response to the correction level adjusting data (correction values) included in the print data of the testing chart TC. On the other hand, when forming a print according to prints data, the correcting level adjusting circuit 35, nozzle counter 37, correction value calculating circuit 39 and correction value storage unit 43 are used. However, the correction level adjusting data (correction values) is not given from the printing data buffer 31 to the correction level adjusting circuit 35, but the correction level adjusting circuit 35 sets the correction values given from the correction value calculating circuit 39 to the drive circuit 33.

Reference is now made back to FIG. 1.

The image processor 27 collects testing image data produced from the scanner 17 scanning the testing chart TC, and acquires correction values, described hereinafter, by carrying out image processing of the testing image data. The acquired correction values are stored in the correction value storage unit 43. The storage mode in that case is in the form of correction value table, for example, which stores the numbers of nozzles 21, and correction values as matched with the numbers. Preferably, a testing chart TC is formed for each type of web paper WP, correction values are acquired for each testing chart TC, and a correction value table is stored for each set of printing conditions such as medium type, printing speed and so on.

Figure 4:
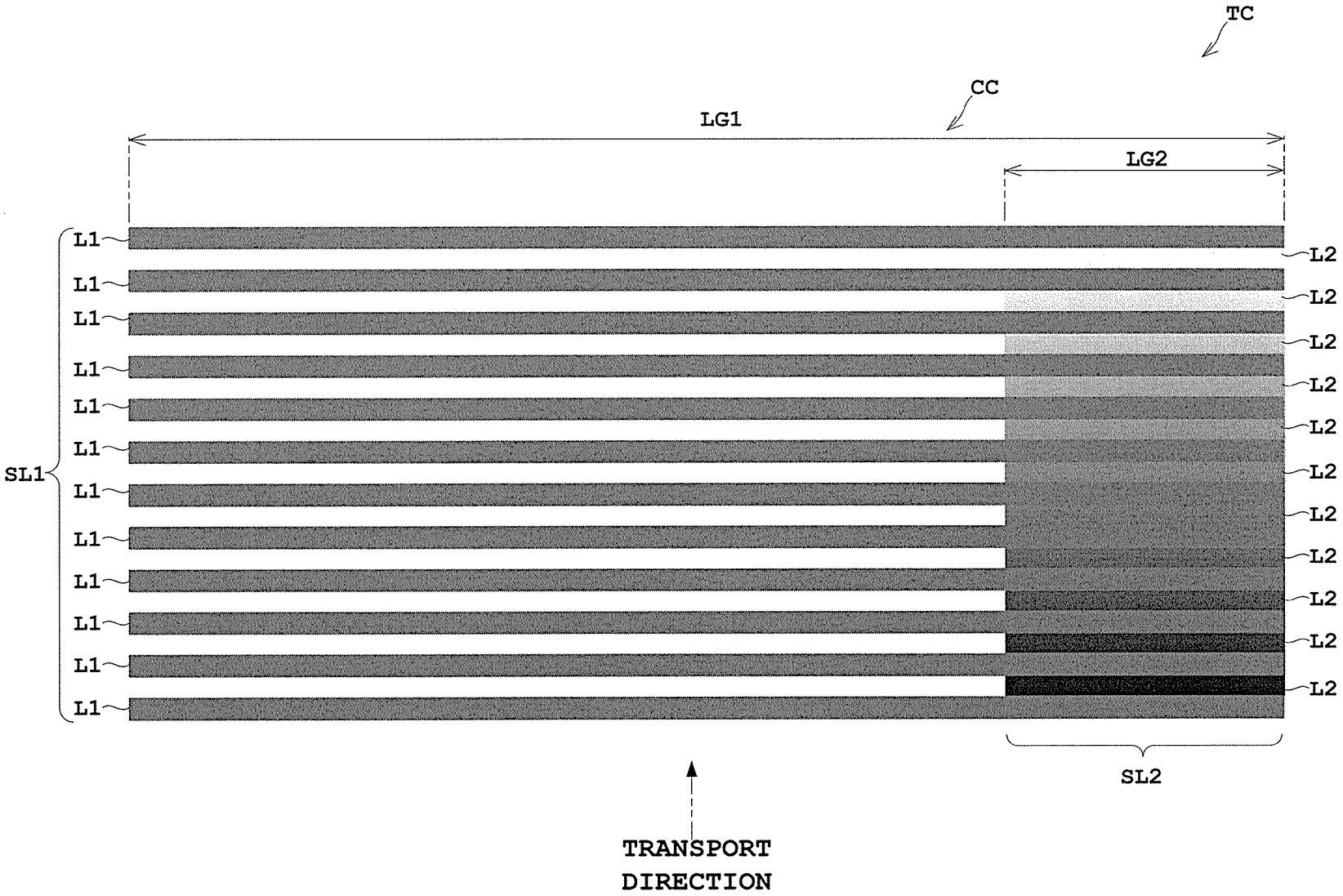
FIG. 4 is a schematic view showing an example of testing charts.

Next, reference is made to FIG. 4. FIG. 4 is a schematic view showing an example of testing charts.

The testing chart TC is in the form of a contrast chart CC including a first line segment group SL1 consisting of a plurality of first line segments L1, and a second line segment group SL2 consisting of second line segments L2 formed alternately with the first line segments L1.

The first line segment group SL1 has a long axis of length LG1 in the direction perpendicular to the transport direction, and has a plurality of (e.g. 12) first line segments L1 with a predetermined width in the transport direction. These first line segments L1 are formed by all the nozzles 21 of the print head 19 arranged in the width direction (direction perpendicular to the transport direction) of the web paper WP. The first line segments L1 do not necessarily need to be formed by all the nozzles 21, but may be formed by the number of nozzles close to the total number of nozzles 21. When forming the first line segment group SL1, the correction level adjusting circuit 35 gives a reference drive signal to the drive circuit 33. This reference drive signal is a signal for causing the density of an image formed by droplet strike from the print head 19 to agree with a predetermined reference density. The total number of nozzles 21 mentioned above refers to a plurality of nozzles 21 that contribute to printing on the web paper WP. This term therefore does not include nozzles 21 existing in positions outside the width of the web paper WP or outside a print area thereof.

The above total number of nozzles 21 corresponds to the "first number of driven nozzles" in this invention.

The second line segment group SL2 has a plurality of (e.g. 11) second line segments L2 formed between the first line segments SL1 constituting the first line segment group SL1. The number of second line segments L2 is determined in response to an increase or decrease in the correction values in a range of adjusting the correction values as described hereinafter. The number of first line segments L1 is determined to be larger by one than the number of second line segments L2 so as to enclose the second line segments L2. These second line segments L2 have a long axis of length LG2 in the direction perpendicular to the transport direction, and the length LG2 is shorter than the length LG of the first line segments SL11. To be particular, a number of nozzles 21 smaller than their total number is selected, and only this selected number of nozzles 21 is used to form the second line segments L2. The selected number may be one half or one third of the total number of nozzles 21, for example. This number may be set appropriately which, by decreasing the number of nozzles 21, will produce an influence on the image formation by the total number of nozzles 21.

For each of the second line segments L2, correction level adjusting data (correction value) is given from the print data buffer 31 to the correction level adjusting circuit 35. As the values, the middle part in the testing chart TC seen in the transport direction is 0, for example, and the absolute value is increased with the distance in the transport direction away from 0 in the middle. When 11 second line segments L2 are provided, for example, the signal (correction value) is incremented by 1 (V) on a line-by-line basis from 0 in the middle. Specifically, the signals are adjusted in a range of −5(V) to +5(V) across 0(V), and the number corresponding to increment 1(V) of the correction value in that range is 11. In this case, therefore, the correction level adjusting data (correction value) is changed to be −5 (V), −4 (V), −3 (V), −2 (V), −1 (V), 0 (V), +1 (V), +2 (V), +3 (V), +4 (V) and +5 (V). As a result, as shown in FIG. 4, each second line segment L2 in the second line segment group SL2 differs in density from the others along the transport direction.

The testing charts TC including the above contrast charts CC are stored beforehand in a testing chart storage unit 45 in the controller 25 and the testing chart storage unit 41 in the host computer HC. Since varied numbers of nozzles are used at the same time at a printing time, it is preferable to prepare testing charts TC in a plurality of types by changing the selected number. However, when each selected number is varied, there will arise inconveniences such as the number of contrast charts CC increasing too much, and an excessive load occurring at a printing time accompanied by corrections. It is therefore preferable to reduce the selected number to one half or one third of the total number of nozzles 21 as noted above. At the printing time, there may be a disagreement between the number of nozzles 21 counted by the nozzle counter 37 and the selected number in the correction value table. However, when the correction value table includes a plurality of selected numbers, a correction value may be derived from an interpolating process.

The testing chart TC noted above is printed on the web paper WP by the print head 19 under control of the controller 25. Then, the printed testing chart TC is scanned by the scanner 17. The testing chart TC is thereby digitized as testing image data, and given to the image processor 27. Of the testing image data, the image processor 27 compares the density of each first line segment L1 and that of each second line segment L2 in the testing chart TC with respect to the transport direction. And a second line segment L2 closest in density to the first line segment L1 is identified. Based on the testing chart TC stored in the testing chart storage unit 45 (or the test chart storage unit 41), correction level adjusting data (correction value) corresponding to the identified second line segment L2 is acquired. The correction level adjusting data (correction value) acquired in this way is stored in the correction value storage unit 43 as a correction value table having the selected number and correction value matched with each other.

When making prints, the correction value calculating circuit 39 refers to the number of the nozzles counted by the nozzle counter 37 and the correction value table in the correction value storage unit 43. The correction value calculating circuit 39 calculates a correction value corresponding to the counted number of nozzles. And the calculated correction value is set to the drive circuit 33 for each one line printing by the print head 19, and printing by the print head 19 is carried out.

The above print head 19 corresponds to the "testing chart forming device" in this invention. The image processor 27 corresponds to the "identifying device" and "correction value acquiring device" in this invention. The head controller 29 corresponds to the "controller" in this invention.

Figure 5:
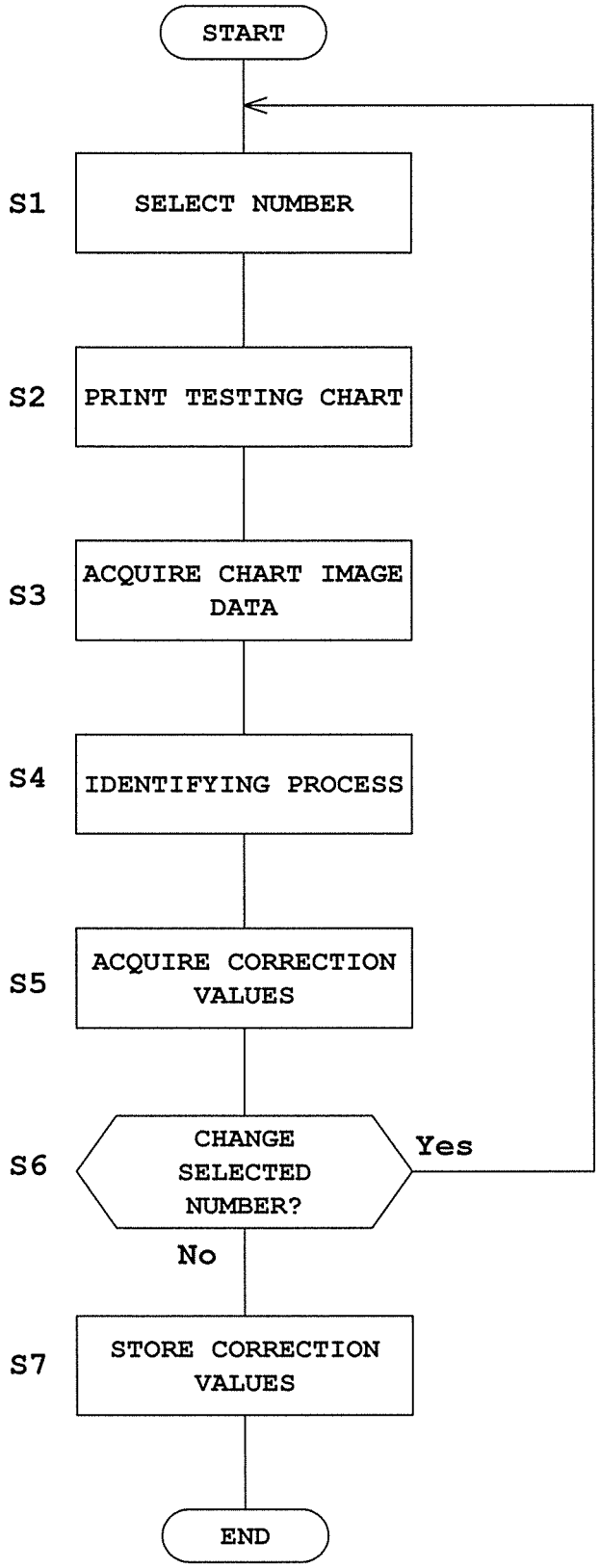
FIG. 5 is a flow chart showing a correction value acquiring process.
Figure 6:
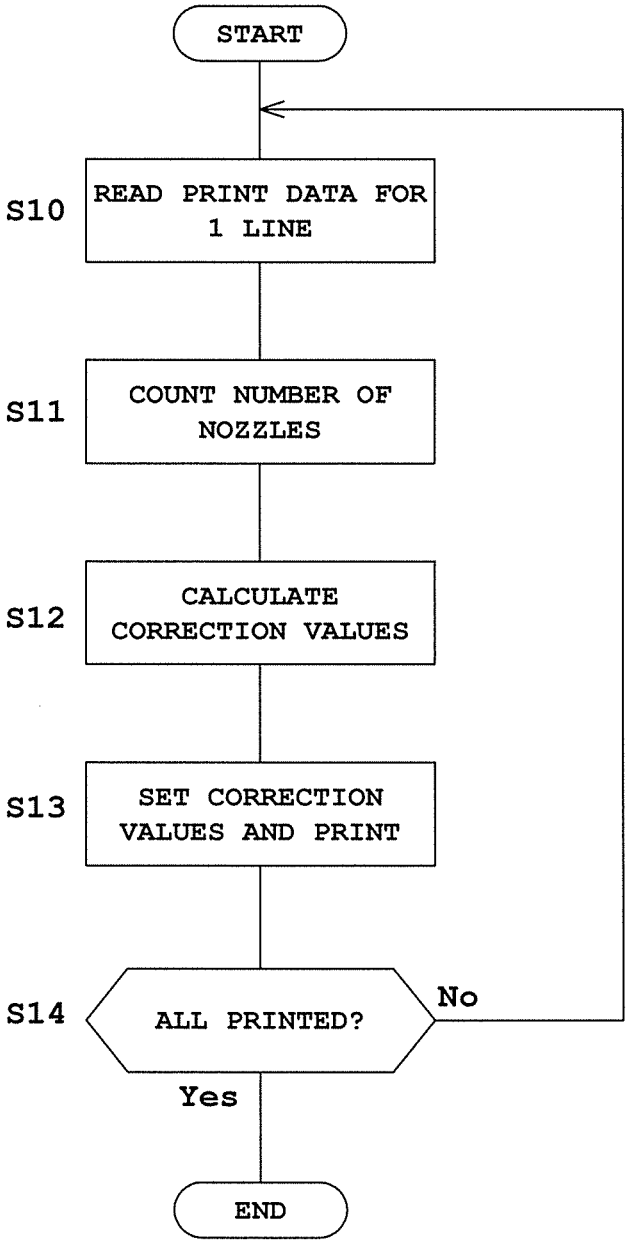
FIG. 6 is a flow chart showing a printing process.

Next, operation for a correction value acquiring process and a printing process based on an acquired correction value will be described with reference to FIGS. 5 and 6. FIG. 5 is a flow chart showing the correction value acquiring process. FIG. 6 is a flow chart showing the printing process.

Step S1 (Selecting Step)

In order to set the number of nozzles 21 as target of discharge correction, a number smaller than the number of nozzles 21 is selected. In determining this selected number, contrast charts CC may be made in a plurality of types in the testing chart TC considering the load and other conditions noted hereinbefore. Specifically, the selected number will be determined by a first contrast chart CC by reading the print data of the testing chart TC.

Step S2 (Testing Chart Forming Step)

The controller 25 reads the testing chart TC from its own testing chart storage unit 45 or the testing chart storage unit 41 of the host computer HC, and causes the print head 19 to print the testing chart TC including the contrast chart CC having the length LG2 of the second line segments L2 corresponding to the selected number. It is preferable to form a testing chart TC for each print head 19 and to print four testing charts TC.

Step S3

The image processor 27 operates the scanner 17 to scan the printed testing chart TC, and acquires the testing image data corresponding to the testing chart TC.

Step S4 (Identifying Step)

The image processor 27 searches the contrast chart CC of the testing image data for locations where the first line segments L1 and second line segments L2 agree in density, and identifies the second line segments L2 in such locations.

Step S5 (Correction Value Acquiring Step)

The image processor 27 acquires the selected number from the testing chart TC, and the correction values for the second line segments L2 from the testing chart TC.

Step S6

The process is branched according to whether to change the selected number or not. When there are contrast charts CC in a plurality of types in the testing chart TC, the controller 25 determines that the selected number is to be changed, and returns to step S1. Then, the above steps S1-S6 are repeated to print contrast charts CC corresponding to a next selected number.

Step S7

After all the contrast charts CC are printed in step S6, the controller 25 stores correction value tables of the selected numbers and the correction values matched with each other in the correction value storage unit 43.

When the correction values have been acquired based on the testing charts TC, printing can be done using the correction values.

Step S10

The controller 25 receives print data for making prints from the host computer HC. The print data buffer 31 of each head controller 29 reads print data for one line which the print head 19 prints at a time.

Step S11

The nozzle counter 37 counts the number of nozzles 21 used by the print head 19 in printing at a time.

Step S12

The correction value calculating circuit 39 refers to the correction value table in the correction value storage unit 43, and calculates the correction value corresponding to the number of nozzles 21 counted in step S11. Although the correction value table is a table showing correlations between selected numbers and correction values as described above, when the number of nozzles 21 is not in agreement with the selected number, a correction value corresponding to a selected number to which the number of nozzles 21 is the closer is simply selected. When, for example, the total number of nozzles 21 is 1024 and the selected number is 512, and the number of nozzles 21 counted in step S11 is 600, a correction value corresponding to selected number 512 is selected. In this way, the process for each line can be lightened. It is also possible to derive a correction value from an interpolating process according to the number of nozzles 21 counted.

Step S13

The head controller 29 operates the correction level adjusting circuit 35 to adjust the correction value calculated or selected by the correction value calculating circuit 39, and gives it to the drive circuit 33. Then, the print head 19 is driven by a corrected drive signal according to the print data to print one line.

Step S14

The controller 25 branches the process based on whether all lines have been printed based on the print data. When the printing has not been completed, the operation returns to step S10 to read data for a next one line, make a correction according to the number of nozzles, and carry out printing. When printing has been completed, the process is ended.

According to this Embodiment 1, the contrast chart CC is formed by the print heads 19 each discharging ink from a plurality of nozzles 21 based on testing chart data. The contrast chart CC includes a first line segment group LS1 having first line segments L1 extending in the direction perpendicular to the transport direction of web paper WP and arranged at predetermined intervals, and a second line segment group LS2 having second line segments L2 formed between the first line segments L1 only with a selected number of nozzles, the second line segments L2 being formed while changing correction values for correcting a drive signal. And based on testing image data of a testing chart TC acquired by the scanner 17, the image processor 27 compares the density of each first line segment L1 and that of each second line segment L2 on the contrast chart CC in the transport direction of web paper WP, identifies a second line segment 2 having a density substantially in agreement with that of the first line segment L1, acquires a correction value corresponding to this second line segment L2 and showing a difference from a reference drive signal, and stores the correction value as matched with the selected number in the correction value storage unit 43. By depicting this testing chart TC, therefore, correction values corresponding to the number of nozzles 21 at the time of image formation can be acquired easily in a short time. When making prints, the nozzle counter 37 counts the number of nozzles 21 based on the print data accumulated in the print data buffer 31. Based on this number and the selected number of nozzles, the controller 25 sets a correction value stored in the correction value storage unit 43 to the drive circuit 33. Therefore, since a correction corresponding to the number of nozzles 21 is made in the drive circuit 33, a reduction in print quality due to the number of nozzles 21 can be inhibited.

Embodiment 2

Embodiment 1 has been described taking for example the print head 19 having a plurality of nozzles 21 integrated together. However, this invention is applicable also to an apparatus including a print head 19 in the form of a plurality of head modules each having a plurality of nozzles 21 integrated together.

Figure 7:
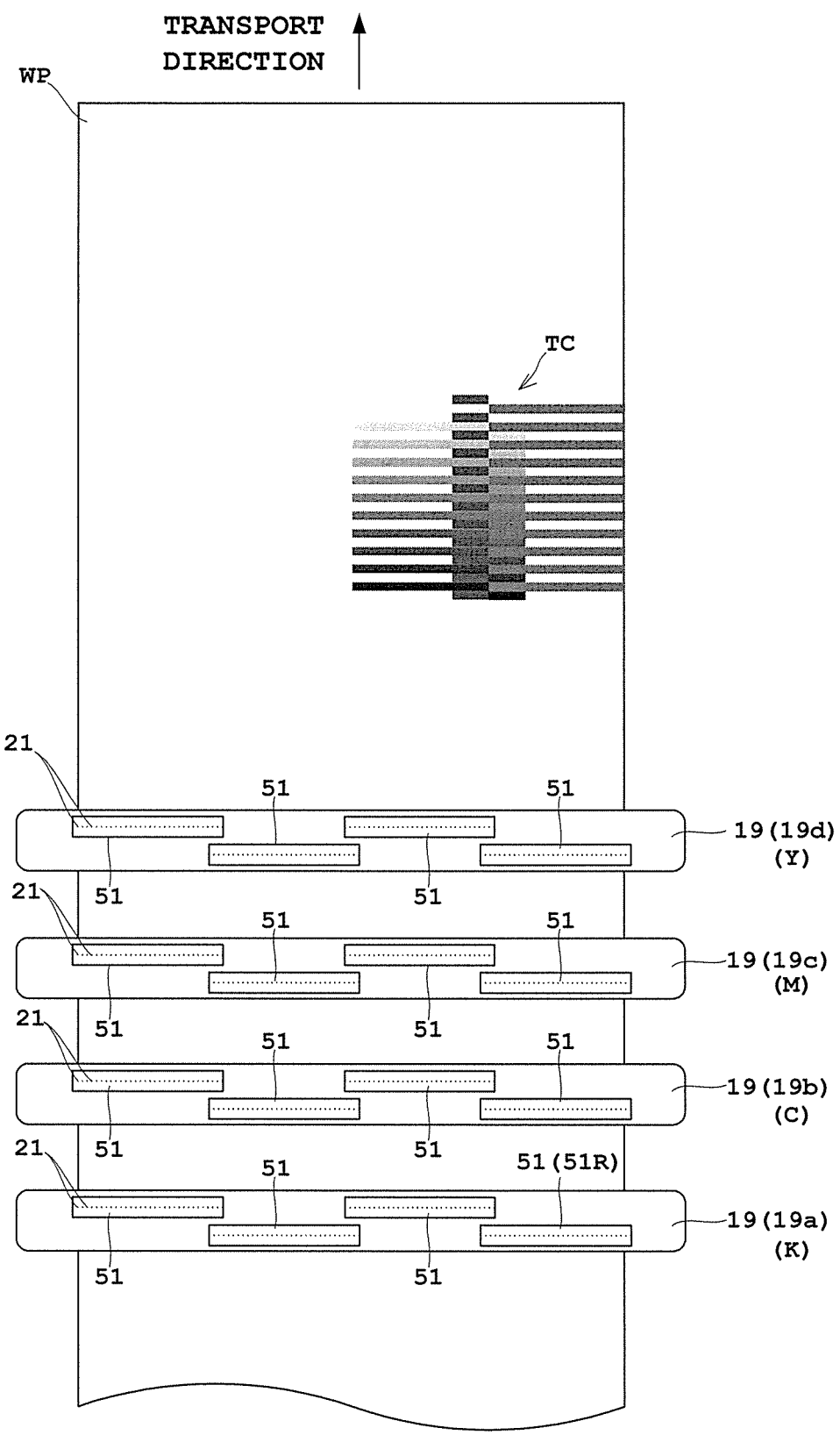
FIG. 7 is a schematic view showing a positional relationship in plan view of each print head having a plurality of head modules and web paper in an inkjet printing apparatus according to Embodiment 2.

Reference is now made to FIG. 7. FIG. 7 is a schematic view showing a positional relationship in plan view of each print head and web paper, each print head having a plurality of head modules in an inkjet printing apparatus according to Embodiment 2.

Each print head 19 has a plurality of head modules 51. Each head module 51 has a plurality of nozzles 21 arranged in the direction perpendicular to the transport direction. In this example, one print head 19 has four head modules 51. In the order of arrangement of the four head modules 51 seen from one end (left end in FIG. 7) in the direction perpendicular to the transport direction, the odd-numbered head modules 51 are shifted downstream in the transport direction, and the even-numbered head modules 51 upstream in the transport direction. Thus, the head modules 51 are in a zigzag arrangement with the ends of adjacent head modules 51 overlapping each other when seen in the transport direction.

Where the print heads 19 are constructed as above, the head controller 29 described hereinbefore is provided for each head module 51. It is therefore possible to set the above-described correction value for each head module 51.

Figure 8:
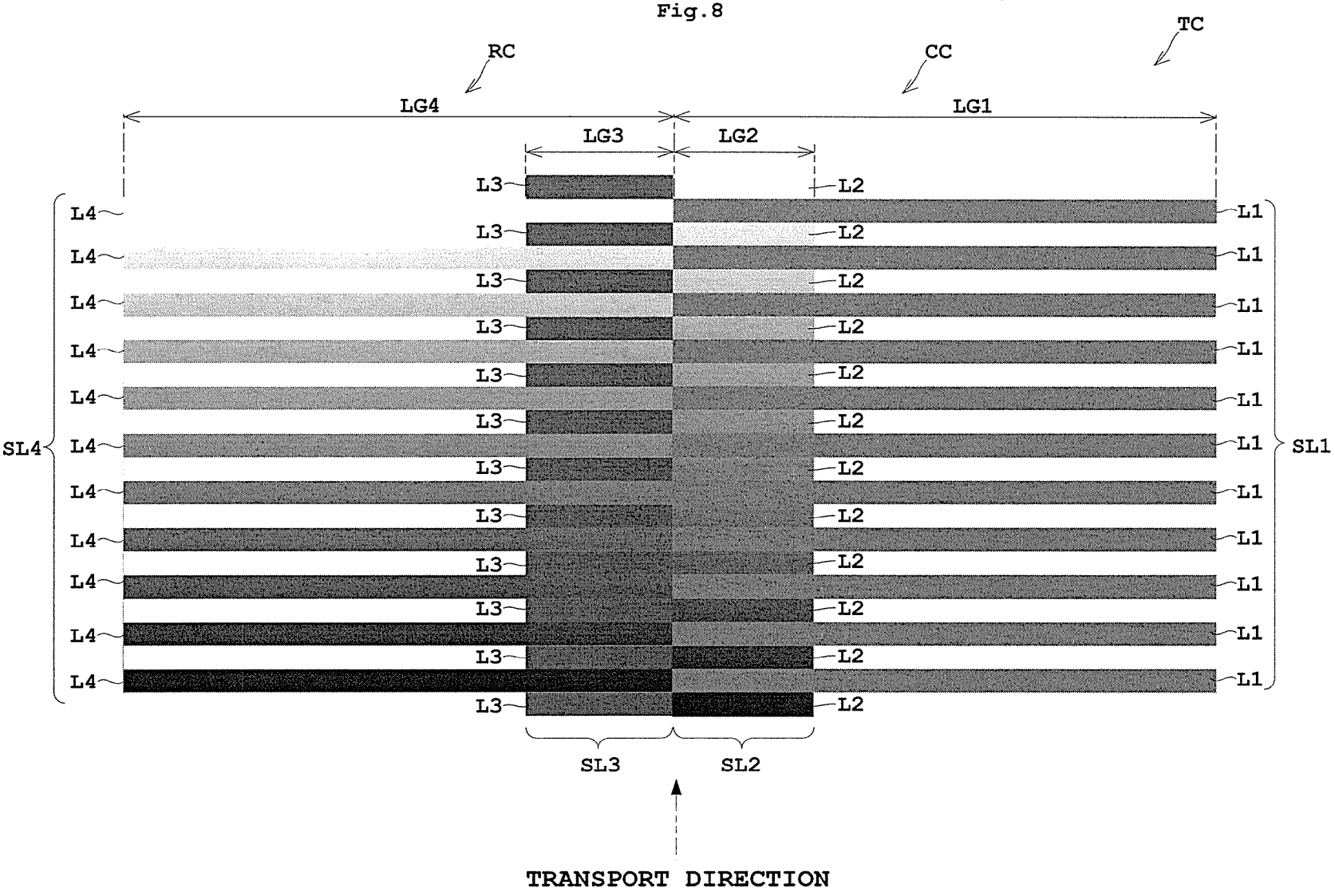
FIG. 8 is a schematic view showing a testing chart according to Embodiment 2.

With such a print head 19, it is preferable to acquire correction values using a testing chart TC as shown in FIG. 8. FIG. 8 is a schematic view showing a testing chart according to Embodiment 2. Where there is a characteristic that no density difference occurs between adjoining head modules 51, correction values may be obtained using the testing chart TC with only the contrast chart CC shown in Embodiment 1.

First, in this example, a reference head module 51R is selected from among the four head modules 51. Here, for example, the head module 51R at the right end in FIG. 7 is made the reference head module 51R.

This testing chart TC has a contrast chart CC formed with the reference head module 51R, and including a first line segment group SL1 consisting of a plurality of first line segments L1, and a second line segment group SL2 consisting of second line segments L2 formed alternately with the first line segments L1, as in Embodiment 1 described hereinbefore. In this contrast chart CC, however, the number of first line segments L1 is 11, and the number of second line segments L2 is 12. The second line segments L2, therefore, are formed between the first line segments L1, and also in positions adjacent the opposite, upstream and downstream ends in the transport direction of the first line segments L1. There is a further difference from the contrast chart CC in foregoing Embodiment 1 in that the second line segment group SL2 is formed in alignment on the left side.

This testing chart TC has a reverse contrast chart RC in addition to the contrast chart CC.

This reverse contrast chart RC is formed with the other head module 51 adjacent the reference head module 51R. Specifically, the reverse contrast chart RC includes a third line segment group SL3 consisting of a plurality of third line segments L3, and a fourth line segment group SL4 consisting of fourth line segments L4. The third line segments L3 and fourth line segments L4 are in a relationship in number similar to that between the first line segments L1 and second line segments L2 described hereinbefore.

The third line segment group SL3 has a long axis of length LG3 in the direction perpendicular to the transport direction, and has a plurality of (e.g. 12) third line segments L3 with a predetermined width in the transport direction. When forming the third line segment group SL3, the correction level adjusting circuit 35 gives a reference drive signal to the drive circuit 33. The third line segments L3 are formed between the first line segments L1 of the contrast chart CC in the width direction of the web paper WP (the direction perpendicular to the transport direction), and adjacent the opposite ends of the first line segments L1 in the transport direction. Their length LG3 is provided by selecting a number smaller than the total number of nozzles 21, and forming the third line segments L3 only with this selected number of nozzles 21. The third line segments L3 have the length LG3 determined by the selected number, which is therefore the same as the length LG2 of the second segment lines L2 of the contrast chart CC noted above.

The fourth line segment group SL4 is formed of a plurality of (e.g. 11) fourth line segments L4 between the third line segments L3 constituting the third line segment group SL3. These fourth line segments L4 are formed by all the nozzles 21 of the other head module 51 adjacent the reference head module 51R, in the width direction of the web paper WP (the direction perpendicular to the transport direction).

For each of the fourth line segments L4, the correction level adjusting data (correction value) from the print data buffer 31 is given to the correction level adjusting circuit 35. As the values, the middle part in the testing chart TC seen in the transport direction is 0, for example, and the absolute value is increased with the distance in the transport direction away from 0 in the middle. That is, the fourth line segment group SL4 is formed with varied density levels as is the second line segment group SL2 of the contrast chart CC.

The testing chart TC formed as described above and printed on the web paper WP is scanned by the scanner 17 to be digitized as testing image data. The image processor 27 compares, with respect to the transport direction, the density of each first line segment L1 and that of each second line segment L2 of the testing image data in the contrast chart CC of the testing chart TC. And a second line segment L2 closest in density to the first line segment L1 is identified. Based on the contrast chart CC, correction level adjusting data (correction value) corresponding to the identified second line segment L2 is acquired. The correction level adjusting data (correction value) acquired in this way is stored in the correction value storage unit 43 as a correction value table for the reference head module 51R having the selected number and correction value matched with each other.

The image processor 27 compares, with respect to the transport direction, the density of each third of line segment L3 and that of each fourth line segment L4 of the testing image data in the reverse contrast chart RC of the testing chart TC. And a fourth line segment L4 closest in density to the third line segment L3 is identified. Based on the reverse contrast chart RC, correction level adjusting data (correction value) corresponding to the identified fourth line segment L4 is acquired. The correction level adjusting data (correction value) acquired in this way is stored in the correction value storage unit 43 as a correction value table for the head module 51 adjacent the reference head module 51R having the selected number and correction value matched with each other.

Further, the image processor 27 compares, with respect to the direction perpendicular to the transport direction, the density of each first line segment L1 of the testing image data in the contrast chart CC of the testing chart TC and that of each fourth line segment L4 in the reverse contrast chart RC. And a fourth line segment L4 substantially in agreement is identified. The correction value corresponding to this fourth line segment L4 represents a difference of the module 51 from the reference drive signal for the reference head module 51R. A correction value corresponding to this difference is stored in the correction value storage unit 43 as a correction value as a correction value between the head modules 51 (51R). This correction value between the modules is used for adjusting the reference drive signal between the head modules 51. That is, this can inhibit variations in density between the head modules 41 occurring at the time of giving the same driving signal to each head module 51 in the same print head 19.

By successively changing the above reference head module 51R, correction values between the modules can be obtained for all the head modules 51 constituting each print head 19. Since a correction value relative to one certain head module 51 can be calculated as a result, it is possible to uniform characteristics for all the head modules 51.

According to this Embodiment 2, in addition to the effects of foregoing Embodiment 1, even where one print head 19 is constructed of a plurality of head modules 51, a reduction in print quality due to the number of nozzles 21 can be inhibited since a correction corresponding to the number of nozzles 21 is carried out in the drive circuit 33. This can also uniform characteristics of the plurality of head modules 51.

This invention is not limited to the foregoing embodiments, but can be modified as follows:

(1) In the foregoing embodiments, the number of first line segments L1 is 12 by way of example. This invention is not limited to such a number. The number of these line segments may be determined in response to an amount of shift of the drive signal from the reference drive signal.

(2) In the foregoing embodiments, the printing medium is exemplified by web paper WP. This invention is applicable to other printing media such as film.

(3) In the foregoing embodiments, the inkjet printing apparatus 3 with four print heads 19 has been described by way of example. This invention is not limited to such construction. For example, this invention is applicable as long as at least one print head 19 is provided.

(4) The foregoing embodiments have been described taking the print head 19*a* for example. The invention is similarly applicable to the other print heads 19*b*-19*d*.

(5) In the foregoing embodiments, the scanner 17 scans the testing charts TC and locations where the first line segments L1 and second line segments L2 agree in density are determined based on the testing image data. However, the determination may be made with human eyes without scanning the testing charts. In that case, for example, correction values may be inputted from a GUI (graphic user interface).

This invention may be embodied in other specific forms without departing from the spirit or essential attributes thereof and, accordingly, reference should be made to the appended claims, rather than to the foregoing specification, as indicating the scope of the invention.

What is claimed is:

1. In an inkjet printing apparatus for forming images on a printing medium with an inkjet head by operating a drive circuit for driving a plurality of nozzles which discharge ink droplets, a testing chart for obtaining correction values for the drive circuit, the testing chart comprising a contrast chart including:

a first line segment group having first line segments formed on the printing medium by causing the drive circuit to output a reference drive signal for a density serving as reference, thereby to make discharge from a first number of driven nozzles of the plurality of nozzles, the first line segments extending in a direction perpendicular to a transport direction of the printing medium and arranged at predetermined intervals in the transport direction; and a second line segment group having second line segments formed on the printing medium by causing the drive circuit to output a drive signal for driving only a selected number of nozzles as target of correction less than the first number of driven nozzles, the second line segments being formed between the first line segments of the first line segment group while changing the correction values for correcting the drive signal of the drive circuit.

2. The testing chart according to claim 1, wherein the contrast chart is provided in a plurality of types by changing the selected number.

3. The testing chart according to claim 2, wherein the first number of driven nozzles is all of the plurality of nozzles.

4. The testing chart according to claim 1, wherein the inkjet head comprises a plurality of head modules each having a plurality of nozzles, and each head module having the drive circuit for driving each of the nozzles of the head module, and wherein:

the contrast chart includes:

the first line segment group formed by the plurality of nozzles of a reference head module which is a given one of the head modules;

the second line segment group formed by the selected number of nozzles of the reference head module; and a reverse contrast chart including:

a third line segment group having third line segments formed on the printing medium by causing the drive circuit to output the reference drive signal for the density serving as reference, thereby to make discharge only from the selected number of nozzles of the plurality of nozzles of an other head module adjacent the reference head module, the third line segments being arranged adjacent spaces between the first line segments of the first line segment group in the contrast chart; and a fourth line segment group having fourth line segments formed on the printing medium by causing the drive circuit to output a drive signal for driving the plurality of nozzles of the other head module, the fourth line segments being formed between the third line segments of the third line segment group while changing the correction values for correcting the drive signal for the drive circuit.

5. The testing chart according to claim 4, wherein the first number of driven nozzles is all of the plurality of nozzles.

6. The testing chart according to claim 4, wherein:

the fourth line segment group has the fourth line segments in a number corresponding to increments in the correction value in a range of adjusting the correction value for correcting the drive signal; and the third line segment group has the third line segments in a number larger by one than the number of the fourth line segments.

7. The testing chart according to claim 1, wherein the first number of driven nozzles is all of the plurality of nozzles.

8. The testing chart according to claim 1, wherein:

the second line segment group has the second line segments in a number corresponding to increments in the correction value in a range of adjusting the correction value for correcting the drive signal; and the first line segment group has the first line segments in a number larger by one than the number of the second line segments.

9. In an inkjet printing apparatus for forming images on a printing medium with an inkjet head by operating a drive circuit for driving a plurality of nozzles which discharge ink droplets, a correction value acquiring method for obtaining correction values for the drive circuit, the method comprising:

a selecting step for selecting a number of nozzles as target of correction less that the plurality of nozzles;

a testing chart forming step for forming a testing chart with a contrast chart including a first line segment group having first line segments formed on the printing medium by causing the drive circuit to output a reference drive signal for a density serving as reference, thereby to make discharge from a first number of driven nozzles of the plurality of nozzles, the first line segments extending in a direction perpendicular to a transport direction of the printing medium and arranged at predetermined intervals in the transport direction, and a second line segment group having second line segments formed on the printing medium by causing the drive circuit to output a drive signal for driving only a selected number of nozzles as target of correction less than the first number of driven nozzles, the second line segments being formed between the first line segments of the first line segment group while changing the correction values for correcting the drive signal of the drive circuit;

an identifying step for identifying a second line segment whose density substantially corresponds to that of the first line segments by comparing, in the transport direction of the printing medium, the density of each of the first line segments and the density of each of the second line segments from the testing chart; and a correction value acquiring step for acquiring a correction value corresponding to the second line segment identified.

10. The correction value acquiring method for the inkjet printing apparatus according to claim 9, wherein the testing chart forming step is executed to form a plurality of contrast charts while changing the selected number in the selecting step.

11. The correction value acquiring method for the inkjet printing apparatus according to claim 10, wherein the first number of driven nozzles is all of the plurality of nozzles.

12. The correction value acquiring method for the inkjet printing apparatus according to claim 9, wherein the inkjet head comprises a plurality of head modules each having a plurality of nozzles, and each head module having the drive circuit for driving each of the nozzles of the head modules, wherein the contrast chart includes:

the first line segment group formed by the plurality of nozzles of a reference head module which is a given one of the head modules;

the second line segment group formed by the selected number of nozzles of the reference head module; and a reverse contrast chart including:

a third line segment group having third line segments formed on the printing medium by causing the drive circuit to output the reference drive signal for the density serving as reference, thereby to making discharge only from the selected number of nozzles of the plurality of nozzles of an other head module adjacent the reference head module, the third line segments being arranged adjacent spaces between the first line segments of the first line segment group in the contrast chart; and a fourth line segment group having fourth line segments formed on the printing medium by causing the drive circuit to output a drive signal for driving the plurality of nozzles of the other head module, the fourth line segments being formed between the third line segments of the third line segment group while changing the correction values for correcting the drive signal of the drive circuit;

wherein the identifying step is executed to identify the second line segment whose density substantially corresponds to that of the first line segment by comparing, in the transport direction of the printing medium, the density of each of the first line segments and the density of each of the second line segments in the testing chart, to identify the fourth line segment whose density substantially corresponds to that of the third line segment by comparing, in the transport direction of the printing medium, the density of each of the third line segments and the density of each of the fourth line segments, and to identify the fourth line segment whose density substantially corresponds to that of the first line segment by comparing, in the direction perpendicular to the transport direction of the printing medium, the density of each of the first line segments and the density of each of the fourth line segments; and wherein the correction value acquiring step is executed to acquire a correction value corresponding to the second line segment identified as an intra-head correction value for the reference head module, to acquire a correction value corresponding to the fourth line segment identified as an intra-head correction value for the other head module, and to acquire a correction value corresponding to the fourth line segment identified in the direction perpendicular to the transport direction of the printing medium as an inter-head correction value for the other head module and the reference head module.

13. The correction value acquiring method for the inkjet printing apparatus according to claim 12, wherein the first number of driven nozzles is all of the plurality of nozzles.

14. The correction value acquiring method for the inkjet printing apparatus according to claim 12, wherein:

the fourth line segment group has the fourth line segments in a number corresponding to increments in the correction value in a range of adjusting the correction value for correcting the drive signal; and the third line segment group has the third line segments in a number larger by one than the number of the fourth line segments.

15. The correction value acquiring method for the inkjet printing apparatus according to claim 9, wherein the first number of driven nozzles is all of the plurality of nozzles.

16. The correction value acquiring method for the inkjet printing apparatus according to claim 9, wherein:

the second line segment group has the second line segments in a number corresponding to increments in the correction value in a range of adjusting the correction value for correcting the drive signal; and the first line segment group has the first line segments in a number larger by one than the number of the second line segments.

17. An inkjet printing apparatus for forming images on a printing medium with an inkjet head by operating a drive circuit for driving a plurality of nozzles which discharge ink droplets, the apparatus comprising:

a testing chart forming device for forming a testing chart with a contrast chart including a first line segment group having first line segments formed at predetermined intervals on the printing medium by causing, based on the testing chart, the drive circuit to output a reference drive signal for a density serving as reference, thereby to make discharge from a first number of driven nozzles of the plurality of nozzles, and a second line segment group having second line segments formed on the printing medium by causing the drive circuit to output a drive signal for driving only a selected number of nozzles as target of correction less than the first number of driven nozzles, the second line segments being formed between the first line segments of the first line segment group while changing correction values for correcting the drive signal of the drive circuit;

an identifying device for identifying a second line segment whose density substantially corresponds to that of the first line segments by comparing, in the transport direction of the printing medium, the density of each of the first line segments and the density of each of the second line segments in the testing chart;

a correction value acquiring device for acquiring a correction value corresponding to the second line segment identified;

a correction value storage device for storing the correction value as matched with the selected number;

a buffer for accumulating print data for forming prints on the printing medium;

a nozzle counter for counting the number of nozzles simultaneously making discharge from the inkjet head based on the print data; and a controller for reading the correction values from the correction value storage device based on the number of nozzles and the selected number, and setting the correction values to the drive circuit to perform printing.

18. The inkjet printing apparatus according to claim 17, wherein the testing chart forming device is arranged to form the contrast chart in a plurality of types by changing the selected number.

19. The inkjet printing apparatus according to claim 17, wherein the inkjet head comprises a plurality of head modules each having a plurality of nozzles, and each head module having the drive circuit for driving each of the nozzles of the head modules, wherein the testing chart forming device is arranged to form:

the first line segment group of the contrast chart by the plurality of nozzles of a reference head module which is a given one of the head modules;

the second line segment group of the contrast chart by the selected number of nozzles of the reference head module; and a reverse contrast chart including:

a third line segment group having third line segments formed on the printing medium by causing the drive circuit to output the reference drive signal for the density serving as reference, thereby to making discharge only from the selected number of nozzles of the plurality of nozzles of an other head module adjacent the reference head module, the third line segments being arranged adjacent spaces between the first line segments of the first line segment group in the contrast chart; and a fourth line segment group having fourth line segments formed on the printing medium by causing the drive circuit to output a drive signal for driving the plurality of nozzles of the other head module, the fourth line segments being formed between the third line segments of the third line segment group while changing the correction values for correcting the drive signal of the drive circuit.

20. The inkjet printing apparatus according to claim 17, wherein the first number of driven nozzles is all of the plurality of nozzles.

* * * * *